United States Patent [19]

Rightmyre

[11] 4,423,951

[45] Jan. 3, 1984

[54] ROLLER TRANSFER CORONA APPARATUS

[75] Inventor: Bruce M. Rightmyre, Carol Stream, Ill.

[73] Assignee: Petro-Fax, Carol Stream, Ill.

[21] Appl. No.: 393,315

[22] Filed: Jun. 29, 1982

[51] Int. Cl.[3] ..... G03G 15/16

[52] U.S. Cl. ..... 355/3 TR; 355/14 TR; 118/621

[58] Field of Search ..... 355/3 TR, 14 TR, 3 R, 355/14 R, 3 SH, 14 SH, 3 TE; 118/661, 620, 621

[56] References Cited

U.S. PATENT DOCUMENTS

| | | | |
|---|---|---|---|
| 3,795,441 | 3/1974 | Hoffman et al. | 355/3 R |
| 3,901,186 | 8/1975 | Hoffman et al. | 118/657 X |
| 3,936,175 | 2/1976 | Jones | 355/3 TR |
| 3,936,174 | 2/1976 | Carpenter | 355/3 R |
| 4,063,808 | 12/1977 | Simpson | 355/3 TR |
| 4,066,352 | 1/1978 | Kameda et al. | 355/3 TR |
| 4,068,937 | 1/1978 | Willemese et al. | 355/3 TR |
| 4,087,169 | 5/1978 | Fantuzzo | 355/3 TR |
| 4,101,212 | 7/1978 | Sumiyoshi et al. | 355/3 TR |
| 4,106,868 | 8/1978 | Ophey | 355/3 TR |
| 4,110,024 | 8/1978 | Gundlach | 355/3 TR |
| 4,110,027 | 8/1978 | Sato et al. | 355/3 TR |
| 4,110,031 | 8/1978 | Ebi et al. | 355/14 TR |
| 4,169,673 | 10/1979 | Sato et al. | 355/3 TR |
| 4,190,348 | 2/1980 | Friday | 355/3 TR |
| 4,357,092 | 11/1982 | Nagoshi | 355/3 TR |
| 4,363,550 | 12/1982 | Toshimitsu et al. | 355/14 SH X |

*Primary Examiner*—A. C. Prescott

*Attorney, Agent, or Firm*—Neuman, Williams, Anderson & Olson

[57] ABSTRACT

The roller transfer corona is an apparatus which eliminates the problem of image voids which exists when folded or creased paper is used as the copy paper in a xerographic copy machine. The apparatus comprises contact means, such as a coated push roller, for physically engaging and forcing the folded copy paper against the photoconductor element of the copy machine in combination with corona means, such as a corona wire, located adjacent to and separate from the contact means, for effecting the transfer of toner particles from the photoconductor element to the copy paper.

16 Claims, 13 Drawing Figures

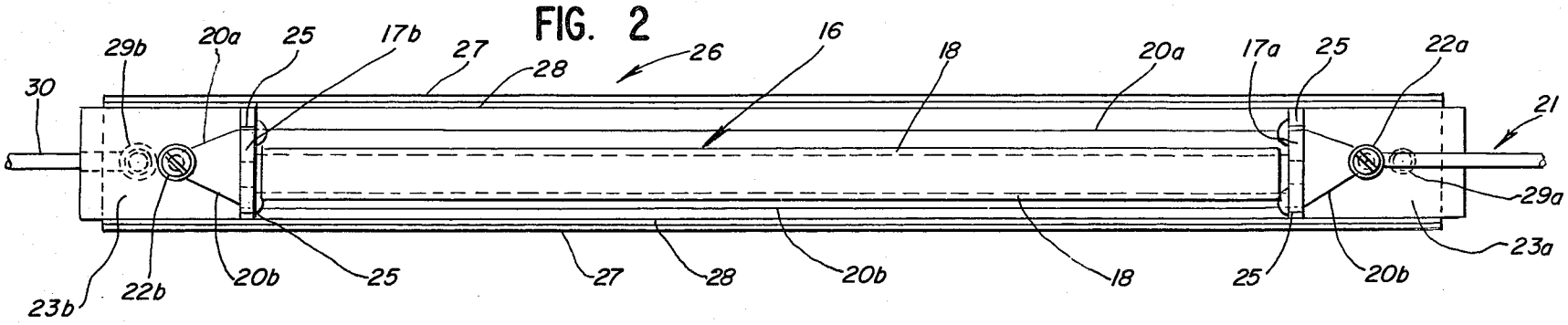
FIG. 2
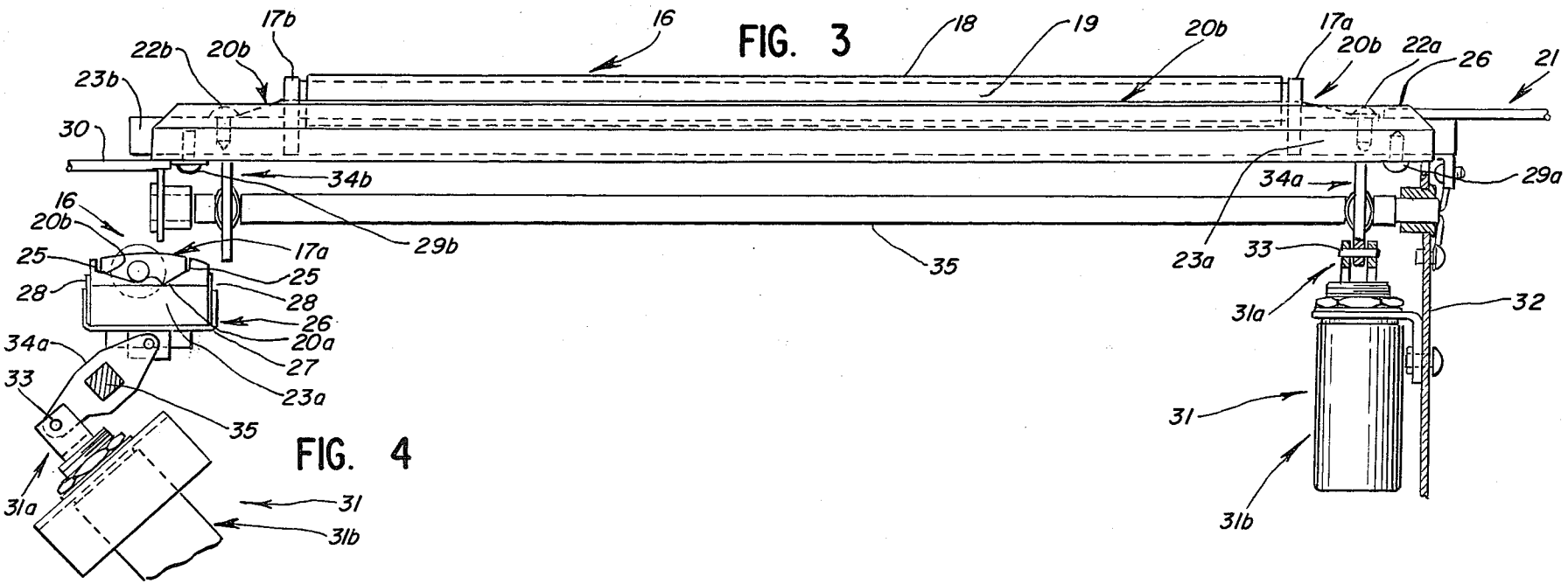
FIG. 3
FIG. 4

ROLLER TRANSFER CORONA APPARATUS

BACKGROUND OF THE INVENTION

1. Field of the Invention

This invention relates to a copy machine for copying extremely long original documents and in particular the copying of these original documents onto folded or otherwise creased paper, such as fan folded and score folded paper, and z-folded perforated paper commonly used in association with computer printout equipment. As used throughout, the term folded or fanfolded is intended to include these and any other similar types of paper. More particularly, this invention relates to a novel roller transfer corona which is part of the overall copy machine and which physically holds the folded copy paper against the photoconductor drum of the copy machine thereby overcoming the problem of image voids that exists when using conventional xerographic and/or electrostatic copying systems with folded copy paper. The invention finds particular application to the copying of well logs and graphs used in the oil industry to evaluate potential oil producing formations. The present invention, however, is not limited to reproducing well logs and graphs but rather can be used to copy any long original document such as electrocardiograms, computer printouts, gas, water and electric utility plat maps and the like.

2. Description of the Prior Art

Diazo copy machines, such as those used for making blueprints, have conventionally been employed for making copies of long original documents onto folded paper, as, for example, in the oil industry where diazo copiers have been used for the copying of well logs and graphs. Diazo copiers, however, suffer from a number of disadvantages. For example, in the diazo process ammonia is used which can permeate the working environment thereby creating adverse working conditions due to the noxious ammonia vapors. This environmental drawback is heightened by the fact that most well logs or graphs are reproduced on site usually in confined locations such as trailers or small temporary buildings. The ammonia vapors also have a corrosive effect on electronic equipment usually found in the small confined space of the copy machine. Another problem common to diazo copiers is that the paper used deteriorates when exposed to sunlight and heat and, therefore, has a short shelf-life. Yet another disadvantage of diazo copying machines is that the diazo copy itself is not permanent and quickly deteriorates.

The prior art also includes xerographic and electrostatic copying machines. Although these apparatus are not conventionally used in the copying of well logs and graphs used in the oil industry, they have eliminated several of the problems mentioned above in connection with the diazo copying machines. One problem which has not been overcome by conventional xerographic and electrostatic copying machines, however, is the problem of image voids that exists when creased or folded paper, such as the paper from computer printouts, is used as copy paper. In the conventional xerographic and electrostatic copying systems the copy paper is held against the photoconductor drum by an electro-magnetic charge on the drum. This charge, however, is often insufficient to securely hold the creased part of folded paper against the drum. Accordingly, when the crease in the folded paper reaches the photoconductor drum it separates from it causing a void on this portion of the copy. This void is very undesirable in that useful information and intelligence is lost on the copy.

The present invention overcomes this problem by the use of a novel mechanism hereinafter called a "roller transfer corona" which physically holds the folded paper against the photoconductor drum. Using a push roller to physically hold the folded copy paper against the drum, however, presents additional problems which are also overcome by the present invention. For example, the photoconductor drum is often made of metal that is coated with selenium, selenium arsenic or selenium tellurium alloys, arsenic tri-selenide, cadmium sulfide, or other suitable photoconductive materials. Such photoconductive materials require care in handling, however, because they are relatively easy to fracture. For example, it has been found that a push roller which constantly engages a photocondutor drum with sufficient pressure to keep folded paper physically in contact with the drum may, after a period of time, deleteriously affect the useful life of the photoconductor drum because it causes the photoconductive material to fracture. Moreover, to keep the folded paper physically in contact with the photoconductor drum the push roller must be sufficiently hard so that it does not cause smearing between the paper and the photoconductor drum while, at the same time, not being so hard as to cause the photoconductive material to fracture.

Another problem encountered by the roller is ozone which is generated by the xerographic process. Ozone can have a deterimental effect on the useful life of materials which might be selected for use in the roller mechanism. Accordingly, selection of a material which is sufficiently hard, yet not too hard, and which is able to withstand an ozone rich atmosphere, is another problem confronted and overcome by the present invention.

The use of a push roller to physically hold the fan folded paper up against the photoconductor drum creates yet another problem which is overcome by the present invention. In the xerographic process the transfer of the toner material to the copy paper is accomplished by the use of a transfer corona. When the roller is physically in contact with the copy paper, thus pressing it against the photoconductor drum, it is difficult to obtain sufficient exposure to the transfer corona at the point of contact to permit adequate transfer of the toner to the copy paper. This problem is overcome in the present invention by including within the roller mechanism transfer corona wires in appropriate locations to provide adequate exposure at the point of contact to the transfer corona.

OBJECTS OF THE INVENTION

It is a general object of the present invention to provide an improved copying machine of the type described which overcomes the problems associated with the copying machines known in the prior art.

It is a further general object of the present invention to provide an improved copying machine which overcomes the problem of image voids associated with the copying onto folded paper.

It is a specific object of the present invention to provide an improved copying machine which includes a roller transfer corona to physically hold folded paper against the photoconductor drum of a conventional xerographic photocopier while providing sufficient exposure to the transfer corona to cause toner to be transferred at the point of contact from the photoconductor drum to the copy paper.

It is a further specific object of the present invention to provide an improved copying machine with a roller transfer corona having a push roller that is resistant to ozone, that is of sufficient hardness to maintain the copy paper in close contact with the photoconductor drum without smearing the image, and which is not of excessive hardness so as to induce fracture of the photoconductive material.

Other objects and advantages of the invention will become apparent upon reading the following detailed description and appended claims, and upon reference to the accompanying drawings.

SUMMARY OF THE INVENTION

In accordance with an embodiment of the invention, a xerographic copy machine is supplied having therein a roller transfer corona. The roller transfer corona has a housing, a push roller coated with an ozone resistant material, such as a material selected from the families of clorosulfonated polyethylene (sold by E. I. duPont deNemours & Company under its trademark "Hypalon"), polycloroprene (sold by E. I. duPont deNemours & Company under its trademark "Neoprene") or polyurethane diisocynate elastomers (urethane or polyester rubbers), and two transfer corona wires running parallel to the longitudinal axis of the roller and located within the housing. The roller selectively engages the photoconductor drum of the copying machine through the use of electronically controlled solenoids. During the copy cycle of the copying machine the solenoids cause the roller to come in contact with the photoconductor drum, which thereby causes the copy paper to be maintained in contact with the photoconductor drum as it passes between the drum and the push roller. This action ensures that creases in folded copy paper are physically in contact with the photoconductor drum. The transfer corona wires on either side of the push roller provide a sufficient charge (either positive or negative, depending on the photoconductive material selected for use on the photoconductor drum) to cause the toner on the photoconducter drum to be transferred to the copy paper despite the presence of the push roller in the corona field. The housing is made of a nonconductive material, such as plastic, to prevent the transfer corona wires from arcing to the housing. At the end of the copy cycle, the solenoids cause the push roller assembly to disengage the drum.

BRIEF DESCRIPTION OF THE DRAWINGS

FIG. 2 is a top plan view of one embodiment of the roller transfer corona apparatus of the present invention;

FIG. 3 is a front elevation view of one embodiment of the roller transfer corona apparatus of the present invention having one solenoid;

FIG. 4 is a right end elevation view of the roller transfer corona apparatus shown in FIG. 3;

It should be understood that the drawings are not necessarily to scale and the embodiments are sometimes illustrated by graphic symbols, phantom lines, diagrammatic representations, and fragmentary views. In certain instances, details which were not necessary for an understanding of the present invention or which render other details difficult to perceive may have been omitted. It should be understood, of course, that the invention is not necessarily limited to the particular embodiments illustrated herein.

DETAILED DESCRIPTION OF THE DRAWINGS INCLUDING PREFERRED EMBODIMENTS

Figure 1:
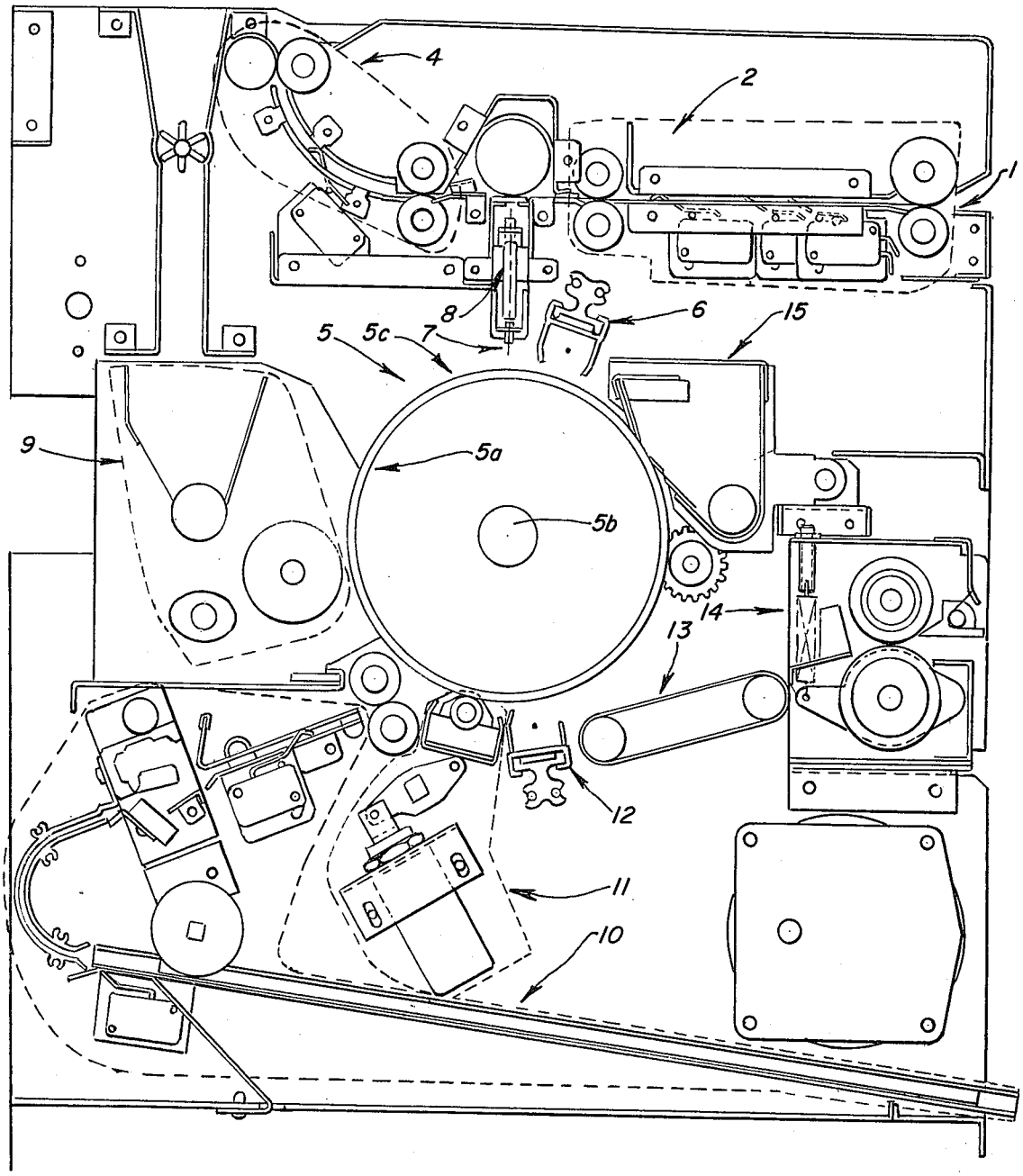
FIG. 1 is a side elevation view of an embodiment of the roller transfer corona apparatus of the present invention in association with a xerographic copy machine of the type for use with transparent or translucent originals.

Turning first to FIG. 1, there is shown in side elevation view a preferred embodiment of the roller transfer corona apparatus of the present invention in association with a conventional xerographic copier. The details of the construction and operation of a conventional xerographic copier shown are well known to those of ordinary skill in the pertinent art and form no part of the present invention. To better understand the function of the present invention, however, a short explanation of some of the essential features of a xerographic copier, and the location of the present invention within the copier, are explained with reference to FIG. 1.

An original document (now shown) is placed in the entry point 1 of exposure section feed roller assembly 2. The exposure section feed roller assembly 2 transfers the original document past an exposure lamp 3 to a discharge roller assembly 4. As the original document is being moved past the exposure lamp 3, a photoconductor drum 5 is rotated counterclockwise past a charge corona assembly 6. The photoconductor drum 5 is conventionally a metal cylinder 5*a* coated with selenium, selenium arsenic or selenium tellurium alloys, arsenic tri-selenide, cadmium sulfide or other suitable photoconductive materials, mounted on a shaft 5*b*. The charge corona assembly 6 charges the surface 5*c* of the photoconductor drum 5. In the case where selenium type photoconductive materials are employed, the charge applied is a positive charge; a negative charge is applied where cadmium sulfide is selected. As the charged photoconductor drum 5 rotates past the exposure aperature 7 of the exposure lens 8, an image of the original document is projected on the surface of the photoconductor drum 5 by the transmission of light from exposure lamp 3 through the nonimage areas of the original document, which in this example is transparent or at least translucent, into the exposure lens 8 and out the exposure aperature 7. In the area on the surface 5*c* of the photoconductor drum 5 where the exposure light is projected, i.e., the non-image area, the charge on the surface 5*c* of the photoconductor drum 5 is neutralized while the image area retains a charged latent image of the original document.

The photoconductor drum 5 continues to rotate counterclockwise past a magnetic brush developer unit 9 which dispenses toner particles to the charged latent image on the photoconductor drum 5, the toner particles having a charge of opposite polarity to the polarity of the latent image so that they are electrostatically attracted to the latent image area. As the photoconductor drum 5 continues to rotate in a counterclockwise direction it comes in contact with a sheet of copy paper (not shown) which is transported by copy paper feed rollers 10 to the vicinity of the roller transfer corona apparatus 11 of the present invention. The roller transfer corona apparatus 11 forces the copy paper tightly against the photoconductor drum 5, and emits a charge of slightly greater magnitude than that of the charge corona 6, which in turn causes the toner particles to release from the surface 5*c* of the photoconductor drum 5 and transfer to the copy paper.

The copy paper is then electrostatically held to the photoconductor drum 5 until it reaches an alternating current stripper corona 12 that neutralizes the charge on the surface of the photoconductor drum 5, thus allowing the copy paper to release from the photoconductor drum 5. By means of a belt conveyor 13, the copy paper, which now has an unfused toner image of the original document on its surface, passes through a heated roller system 14. The heated roller system 14 melts and fuses the toner image into the copy paper which now becomes the finished copy. Continuing counterclockwise, any toner particles remaining on the photoconductor drum 5 are removed by a cleaning blade unit 15. The photoconductor drum 5 is now ready to repeat the copy cycle.

Figure 1A:
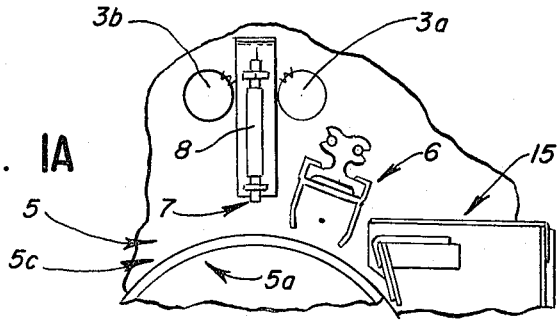
FIG. 1*a* is a detail of one part of the copy machine of FIG. 1 as modified for use with opaque originals.

Referring now to FIG. 1*a*, a detail for adapting the xerographic copy machine shown in FIG. 1 for use in copying opaque originals is shown. In place of the exposure lamp 3 of FIG. 1, two exposure lamps 3*a* and 3*b* are provided and located beneath the path of the original document. Light from exposure lamps 3*a* and 3*b* is reflected off the face of the original document (necessarily in a face down position) and then through exposure lens 8. Except as indicated above, the operation and structure of the copier may be identical to the copier described in FIG. 1.

Referring now to FIGS. 2, 3 and 4 there is shown a top plan view, a front elevation view, and a right end elevation view, respectively, of one embodiment of the roller transfer corona apparatus 11 of the present invention. Push roller 16 is supported at each end by roller supports 17*a* and 17*b* which permit the free rotation of said push roller 16. The push roller 16 is preferentially coated with a seamless coating 18 selected from the families of clorosulfonated polyethylene (sold by E. I. duPont deNemours & Company under its trademark "Hypalon"), polycloroprene (sold by E. I. duPont deNemours & Company under its trademark "Neoprene") or polyurethene diisocynate elastomers (urethane or polyester rubbers) or another suitable ozone resistant material of sufficient hardness to prevent smearing of the toner image when contact is made between the push roller surface and the copy paper, yet which is soft enough to reduce the tendency of the photoconductive material on the photoconductor drum 5 to fracture upon repeated contact with the push roller 16. It has been found that materials having an indentation hardness by durometer in the range of about A40 to about A70 as determined in accordance with ASTM test method D2240 are suitable, although materials with an indentation hardness in the range of about A60 to A70 are preferred, and those with an indentation hardness of about A65 are most preferred.

In this embodiment of the invention the length of the push roller 16 is approximately 11 inches from support 17*a* to support 17*b*, and the coated contact surface of the push roller 16 is approximately 9 inches long. It has been found that the preferential diameter for the coated contact portion of the push roller 16 for this length roller is approximately 0.5 inches, the seamless coating 18 being applied in a thickness of about 0.0625 inches to a 0.375 inch diameter metal roller 19.

Located parallel to the axis of the push roller 16 are transfer corona wires 20*a* and 20*b*. The transfer corona wires 20*a* and 20*b* are made of a suitable conductive material. Tungsten wire, which may be gold plated, having a diameter in the range of about 0.5 to about 5.0 mil is practical, although a diameter of about 1.0 to about 2.0 mil is preferred. The transfer corona wires 20*a* and 20*b* are electrically connected at one end to the high voltage lead 21 of a direct current power supply (not shown) by means of threaded connector 22*a* which is, in turn, securely fastened to insulator block 23*a*. A similar arrangement secures the other end of the transfer corona wires 20*a* and 20*b* to insulator block 23*b* by means of threaded connector 22*b*. The insulator blocks may be made of any suitably nonconductive material, for example a plastic such as acetal resin (sold by E. I. duPont deNemours & Company under its trademark "Delrin").

Between their ends the transfer corona wires 20*a* and 20*b* are suspended on either side of push roller 16 by means of vertical slots 25 located in roller supports 17*a* and 17*b*. While the slots 25 may be equidistant from the longitudinal axis of the push roller 16, it may be advantageous in some copy machines to place the slots 25 an unequal distance from the axis of the push roller, as shown in FIGS. 2 and 4, to maximize the distance and thereby minimize the interference between the transfer corona wires 20*a* and 20*b* and the alternating current stripper corona 12. Also, although the bottom of slots 25 are shown to be at about the same elevation as the axis of push roller 16, which is preferred, it will be appreciated by those of ordinary skill in the pertinent art that the slots 25 and consequently the transfer corona wires 20*a* and 20*b* may be positioned in any number of locations so long as they are sufficiently proximate the push roller 16 to provide an adequate and reasonably uniform transfer corona to cause the toner particles to transfer to the copy paper at the point of contact.

The corona wires emit a charge of slightly greater magnitude than the charge generated by the charge corona 6 (shown in FIG. 1). For example, when a selenium type photoconductive material is employed on the photoconductor drum 5, a positive potential in the range of about 5,800 kV to about 6,000 kV is supplied to the charge corona 6, whereas a positive potential in the range of about 6,200 kV to about 6,300 kV is supplied to the transfer corona wires 20*a* and 20*b*. The charge and transfer coronas are effected by electrically connecting the ground lead of the direct current power supply to metal cylinder 5*a* of the photoconducter drum 5. This connection may be made through the shaft 5*b* which in turn would be connected to the metal cylinder 5*a* of the photoconductor drum 5.

Housing assembly 26 is shown in this embodiment of the invention as a U-shaped channel 27 to which side walls 28 are fixedly attached, in part by insulator blocks 23*a* and 23*b* which are fixedly attached to the channel 27 by threaded connectors 29*a* and 29*b*. To help prevent static electricity from building up on the housing assembly 26 and thus causing toner particles to accumulate on the interior surfaces thereof and on the push roller 16, a ground wire 30 is preferably attached to threaded connector 29*b*. In addition, the housing assembly 26 is preferably constructed from a nonconductive material, for example, a plastic such as acetal resin (sold by E. I. duPont deNemours & Company under its trademark "Delrin"), to minimize the possibility or arcing from the transfer corona wires 20*a* and 20*b*. Where space permits and arcing is not a problem, however, the housing assembly 26 may could also be made of metal. In that case, at least the interior faces of the housing assembly would preferably be coated with a material such as polytetrafluoroethylene (sold by E. I. duPont deNemours & Company under its trademark "Teflon") to again minimize the tendency of toner particles to adhere to the interior surfaces of the housing and to provide some insulative barrier between the transfer corona wires 20*a* and 20*b* and the housing assembly 26.

Selective engagement of the push roller 16 with the photoconductor drum 5 is controlled electronically through solenoid 31, the push roller 16 preferably engaging the photoconductor drum 5 just before the leading edge of the copy paper reaches the point of engagement, about ⅛ of an inch being practical. The solenoid 31, which may be either a push type or a pull type, the pull type being preferred in the embodiment illustrated in FIGS. 3 and 4, is fixedly mounted to the frame 32 of the copy machine. The piston 31*a* of solenoid 31 is operatively connected through linch pin 33 to linkage arm 34*a* which in turn is attached to the bottom of the roller support 17*a*. Linkage arm 34*a* and linkage arm 34*b*, which is operatively connected to the bottom of roller support 17*b*, are also pivotally connected to fulcrum bar 35. Fulcrum bar 35 is, in turn, rotatably mounted at its ends to the frame 32 of the copy machine. To minimize the possibility of current passing from the transfer corona wires 20*a* and 20*b* through the linkage arms 34*a* and 34*b* to the solenoid 31, the linkage arms are preferably constructed from a nonconductive material, for example, a plastic such as acetyl resin ("Delrin").

In the embodiment described above, it will be appreciated that when the piston 31*a* extends out from body 31*b* of the solenoid 31, it thereby rotates linkage arm 34*a* about the fulcrum bar 35, thus also rotating said fulcrum bar 35 which turns linkage arm 34*b*. The rotation of linkage arms 34*a* and 34*b* in turn causes roller supports 17*a* and 17*b* to disengage push roller 16 from the photoconductor drum 5. Conversely, when piston 31*a* retracts into the body 31*b* of solenoid 31, it rotates the linkage arm 34*a* and thus, through fulcrum bar 35, linkage arm 34*b* so that the roller supports 17*a* and 17*b* are pushed upward, thereby causing the push roller 16 to engage the photoconductor drum 5. Preferentially, the solenoid 31 should provide a hold force in the range of about 2 to about 4 pounds per linear inch of roller. Also, a solenoid which can provide this force with a small amount of travel by the piston, say ⅛ of an inch, is also preferred so that the distance which the push roller 16 moves between its engaged position and its disengaged position is kept to a minimum, thereby minimizing wear. It will, of course, be appreciated by one of ordinary skill in the pertinent art that if a pull type solenoid is employed, the piston 31*a* is normally in an extended position, and, accordingly, push roller 16 will engage photoconductor drum 5 when current is supplied to the solenoid 31. On the other hand, when a push type solenoid is employed the piston 31*a* is normally in a retracted position, push roller 16 therefore disengaging photoconductor drum 5 when current is supplied to the solenoid 31.

Figure 5:
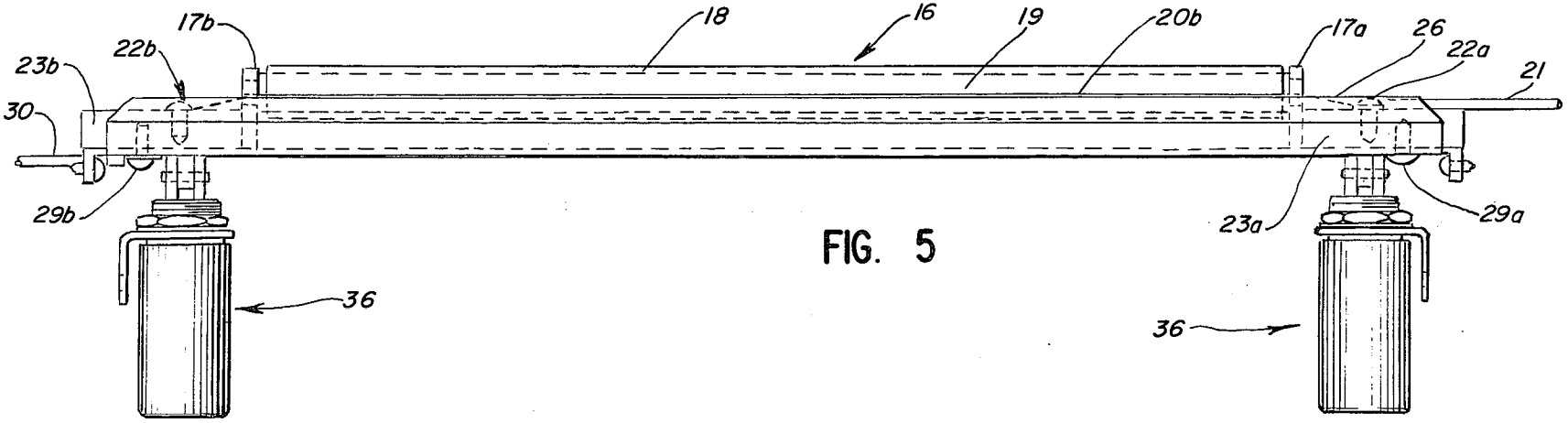
FIG. 5 is a front elevation view of an alternative embodiment of the roller transfer corona apparatus of the present invention having two solenoids.
Figure 6:
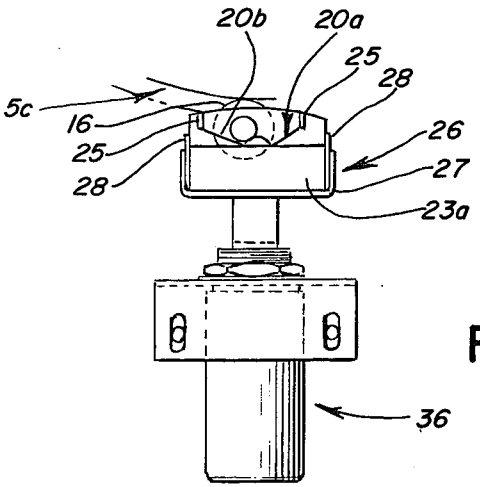
FIG. 6 is a right end elevation view of the roller transfer corona apparatus shown in FIG. 5.

Referring now to FIGS. 5 and 6, an alternative embodiment of the present invention is shown wherein the means for selective engagement of the push roller 16 comprise two solenoids 36 in place of the solenoid 31, linkage arms 34*a* and 34*b*, and fulcrum bar 35 illustrated in FIGS. 3 and 4 and described above. Solenoids 36 are each fixedly mounted to the frame 32 of the copy machine. Each is preferably a push-type solenoid so that when supplied with power, the solenoids 36 push upwards on roller supports 17*a* and 17*b*, thereby causing the push roller 16 to engage the photoconductor drum 5. Again, the preferred hold force is in the range of about 2 to about 4 pounds per linear inch of roller, each of said solenoids preferably supplying about one-half of the total force.

Figure 7:
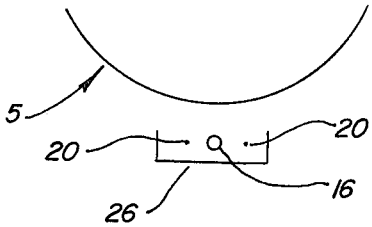
FIG. 7 is a schematic side elevation view of an embodiment of the roller transfer corona apparatus shown in FIGS. 2, 3, 4, 5 and 6 having one push roller and two transfer corona wires.
Figure 7A:
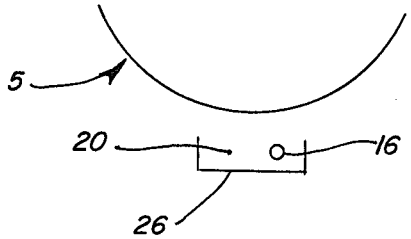
FIG. 7*a* is a schematic side elevation view of an alternative embodiment of the roller transfer corona apparatus of the present invention having one push roller and one transfer corona wire.
Figure 7B:
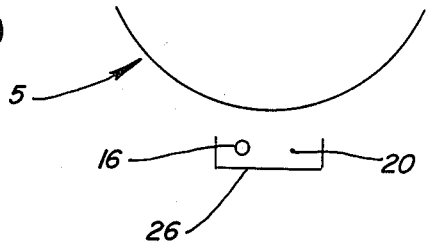
FIG. 7*b* is a schematic side elevation view of yet another embodiment of the roller transfer corona apparatus of the present invention having one push roller and one transfer corona wire.
Figure 7C:
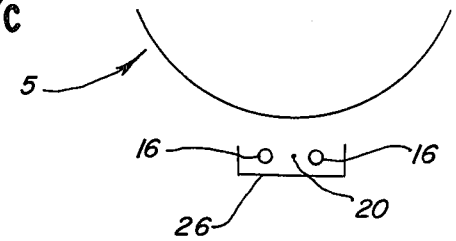
FIG. 7*c* is a schematic side elevation view of yet another embodiment of the roller transfer corona apparatus of the present invention having two push rollers and one transfer corona wire.
Figure 7D:
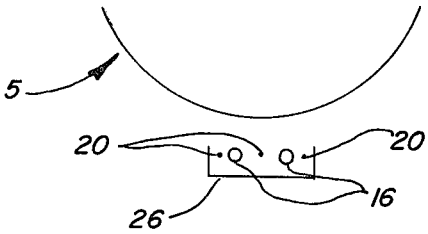
FIG. 7*d* is a schematic side elevation view of yet another embodiment of the roller transfer corona apparatus of the present invention having two push rollers and three transfer corona wires.

A schematic side elevation view of the embodiment of the present invention described above is shown in FIG. 7. It will be noted that the push roller 16 in FIG. 7 has two transfer corona wires 20*a* and 20*b*, one on each side. Other embodiments of the present invention are shown in FIGS. 7*a* through 7*d*. Thus it will be appreciated that a single push roller 16 with a transfer corona wire 20 on either side is within the scope of the present invention as illustrated in FIGS. 7*a* and 7*b*. Similarly, an embodiment having two push rollers 16 and one transfer corona wire 20 as shown in FIG. 7*c* and an embodiment having two push rollers 16 and three transfer corona wires 20 as shown in FIG. 7*d* are also within the scope of the present invention. In light of the description given herein above, other combinations of push rollers and transfer corona wires would also be readily understood by one of ordinary skill in the art reading this disclosure to be within the scope and spirit of the present invention.

Figure 8:
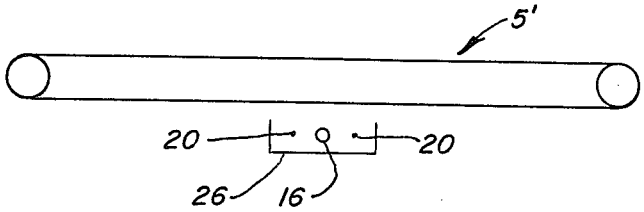
FIG. 8 is a schematic side elevation view of an embodiment of the roller transfer corona apparatus of the present invention in association with a photoconductor coated belt in place of a photoconductor drum.

Moreover, although the invention described herein has been explained in association with a copy machine employing a photoconductor element in the shape of a drum, it will be appreciated that the invention is not limited to use in such a copying machine but may also be employed in copy machines which utilize a photoconductor coated belt 5' as schematically represented in FIG. 8. Also, while this invention was conceived and reduced to practice to solve problems associated with the copying of well logs and graphs utilized in the oil industry, it will be recognized by one or ordinary skill in the pertinent art that the methods and apparatus disclosed herein are also suitable for solving problems associated with the copying onto folded copy paper of microfilm, diagnostic graphs used in the medical field, galley proofs, research graphs, and other lengthy documents, whether the original be either opaque, translucent or transparent.

Having described the invention, what is claimed is:

1. A transfer corona assembly for use in a copy machine having a photoconductor coated element with toner particles forming an image and in which the image is transferred onto copy paper having at least one fold, said transfer corona assembly eliminating image voids at said fold and comprising:

contact means for physically engaging said folded copy paper and forcing said folded copy paper against said photoconductor coated element;

corona means for effecting the transfer of said toner particles forming an image from said photoconductor coated element to said folded copy paper;

housing means within which said corona means and said contact means are located; and said corona means positioned adjacent to and spacially separated from said contact means for causing said toner particles to transfer to said copy paper at the point of contact between said copy paper and said photoconductor coated element and thereby also effecting transfer of said toner particles at the fold of said copy paper.

2. A transfer corona assembly as set forth in claim 1 wherein said contact means comprises at least one push roller having a generally cylindrical surface for engaging said folded copy paper at substantially every point along the entire width of said folded copy paper and for forcing said folded copy paper against said photoconductor coated element.

3. A transfer corona assembly as set forth in claim 2 wherein said push roller further comprises a seamless coating covering said generally cylindrical surface.

4. A transfer corona assembly as set forth in claim 3 wherein said seamless coating has an indentation hardness sufficient to maintain said folded copy paper in nonsmearing contact with said photoconductor coated element but less than an indentation hardness which would fracture said photoconductor coated element.

5. A transfer corona assembly as set forth in claim 3 wherein said seamless coating is selected from the group consisting of clorosulfonated polyethylene, polycloroprene and polyurethane diisocynate elastomers.

6. A transfer corona assembly as set forth in claims 3, 4 or 5 wherein said seamless coating has an indentation hardness as measured by durometer in the range of about A40 to about A70.

7. A transfer corona assembly as set forth in claims 3 or 4 wherein said seamless coating is resistant to ozone.

8. A transfer corona assembly as set forth in claim 2, 3, 4 or 5 wherein said push roller exerts a force against the photoconductor coated element in the range of about 2 to about 4 pounds per linear inch of roller.

9. A transfer corona assembly as set forth in claims 1, 2, 3, 4 or 5 wherein said corona means comprises at least one transfer corona wire.

10. A transfer corona assembly as set forth in claim 9 wherein said transfer corona wire is mounted in spatial relationship to said push roller and extends substantially along and in parallel to the entire length of said push roller.

11. A transfer corona assembly as set forth in claim 10 wherein said transfer corona wire is tungsten wire having a diameter in the range of about 0.5 to about 5.0 mil.

12. A transfer corona assembly as set forth in claim 8 wherein said contact means further comprises bistable means for engaging said push roller to force said folded paper into contact with said photoconductor coated element and to maintain said contact during copying.

13. A transfer corona assembly as set forth in claim 12 further comprising first linkage means connected to said bistable means and to said push roller for moving said push roller into and out of engagement with said photoconductor coated element.

14. A transfer corona assembly as set forth in claim 13 further comprising:

a second linkage means connected to said push roller; and a fulcrum bar connected between said first and second linkage means for causing cooperative movement of said first and second linkage means for moving said push roller into and out of engagement with said photoconductor coated element.

15. A transfer corona assembly as set forth in claim 10 wherein said contact means further comprises bistable means for engaging said push roller to force said folded paper into contact with said photoconductor coated element and to maintain said contact during copying.

16. A transfer corona assembly as set forth in claim 15 further comprising linkage means connected to said bistable means and to said push roller for moving said push roller into and out of engagement with said photoconductor coated element.

* * * * *